United States Patent [19]

Sando et al.

[11] 4,244,200

[45] Jan. 13, 1981

[54] APPARATUS FOR SUPPLYING A DEFINITE AMOUNT OF A TREATING LIQUID TO A TEXTILE PRODUCT CONTINUOUSLY

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 52,307

[22] Filed: Jun. 26, 1979

[30] Foreign Application Priority Data

Jul. 5, 1978 [JP] Japan ..... 53-81664

[51] Int. Cl.[3] ..... D06B 1/14

[52] U.S. Cl. ..... 68/202; 118/70; 118/259; 118/262

[58] Field of Search ..... 68/202; 118/258, 259, 118/261, 70, 262

[56] References Cited

U.S. PATENT DOCUMENTS

| | | | |
|---|---|---|---|
| 547,689 | 10/1895 | Simons | 68/202 |
| 2,045,755 | 6/1936 | Cohn | 68/202 X |
| 2,543,098 | 2/1951 | Dulken et al. | 68/202 |
| 2,649,758 | 8/1953 | Cowgill | 118/261 X |

FOREIGN PATENT DOCUMENTS

| | | | |
|---|---|---|---|
| 480122 | 2/1938 | United Kingdom | 68/202 |
| 1241799 | 8/1971 | United Kingdom | 118/261 |

*Primary Examiner*—Philip R. Coe

*Attorney, Agent, or Firm*—Toren, McGeady and Stanger

[57] ABSTRACT

An apparatus for supplying a definite amount of a treating liquid to a textile product continuously, including a liquid retaining roll having a fine uneven surface or closely spaced small holes all over its surface to retain a treating liquid on the surface thereof, a device to supply a treating liquid to the liquid retaining roll by eliminating the flock and hards of the textile product and other dust adhering thereon, a doctor roll in contact with the liquid retaining roll to control the treating liquid adhering to the liquid retaining roll to a definite amount by pressing, a rubber roll to guide a textile product to be treated continuously, the rubber roll being in pressure contact with the said liquid retaining roll by putting the textile product therebetween to transfer a prescribed amount of the treating liquid to the textile product, and a device to clean the surface of the rubber roll by utilizing a circulated part of the said treating liquid.

5 Claims, 5 Drawing Figures

APPARATUS FOR SUPPLYING A DEFINITE AMOUNT OF A TREATING LIQUID TO A TEXTILE PRODUCT CONTINUOUSLY

The present invention relates to an apparatus for supplying a definite amount of a liquid to a textile product, with which a textile product such as a cloth, a belt to a yarn can be impregnated continuously with a definite amount of a liquid such as a dye solution.

To impregnate, for instance, a cloth with a dye solution for dyeing or a resin solution for resin-treating, it has been a conventional practice to immerse a cloth to be treated in a liquid tank containing a treating solution, to take out the immersed cloth from the tank, to press the cloth with a press roll strongly to remove the excess of the liquid from the cloth and to transfer the cloth for further treatments. In using such a press roll, however, it is very difficult to render a liquid contained in a cloth after pressing to a prescribed amount precisely, and moreover, it is impossible to render the amount to less than 60%.

A process and an apparatus for supplying a definite amount of liquid precisely to a textile product to be treated has been proposed by the present applicants, in which a prescribed amount (for instance, less than 30%) of a treating liquid can be applied precisely and uniformly to a textile product to be treated. The process comprises coating the surface of a mesh roll having small holes in close spacings or a roulette roll having numerous fine roulette-type unevennesses with a liquid, removing the excess of the liquid adhered on the surface of the mesh roll or the roulette roll with the use of a knife-type doctor composed of rubber, a resin or a metal so as to control the liquid adhering on the surface of the said roll to a prescribed amount and then transferring the definite amount of the liquid thus adhered on the surface of the roll to a textile product to be treated by contacting the textile product with the roll.

This prior art has, however, such drawbacks that, since the surface of the mesh roll or the roulette roll, on which the cloth is to be contacted, is always in pressure contact with a knife-type doctor composed of rubber, a resin or a metal, flock and hards of the textile product and other dust are bitten in between the roll and the doctor causing non-uniform adhesion of the liquid around the roll and damage of the roll surface. Further, since the roll the doctor are abrased in a long run operation, they must be repaired or exchanged periodically.

Accordingly, the present invention is to offer an apparatus for supplying a definite amount of a treating liquid to a textile product, in which a definite amount of the liquid can be applied on the surface of a mesh roll or a roulette roll without the use of a knife-type doctor by eliminating the accumulation of flocks and hards of the textile product and other dust.

The present invention will be explained in detail according to the drawings showing an example thereof in the following:

Figure 1:
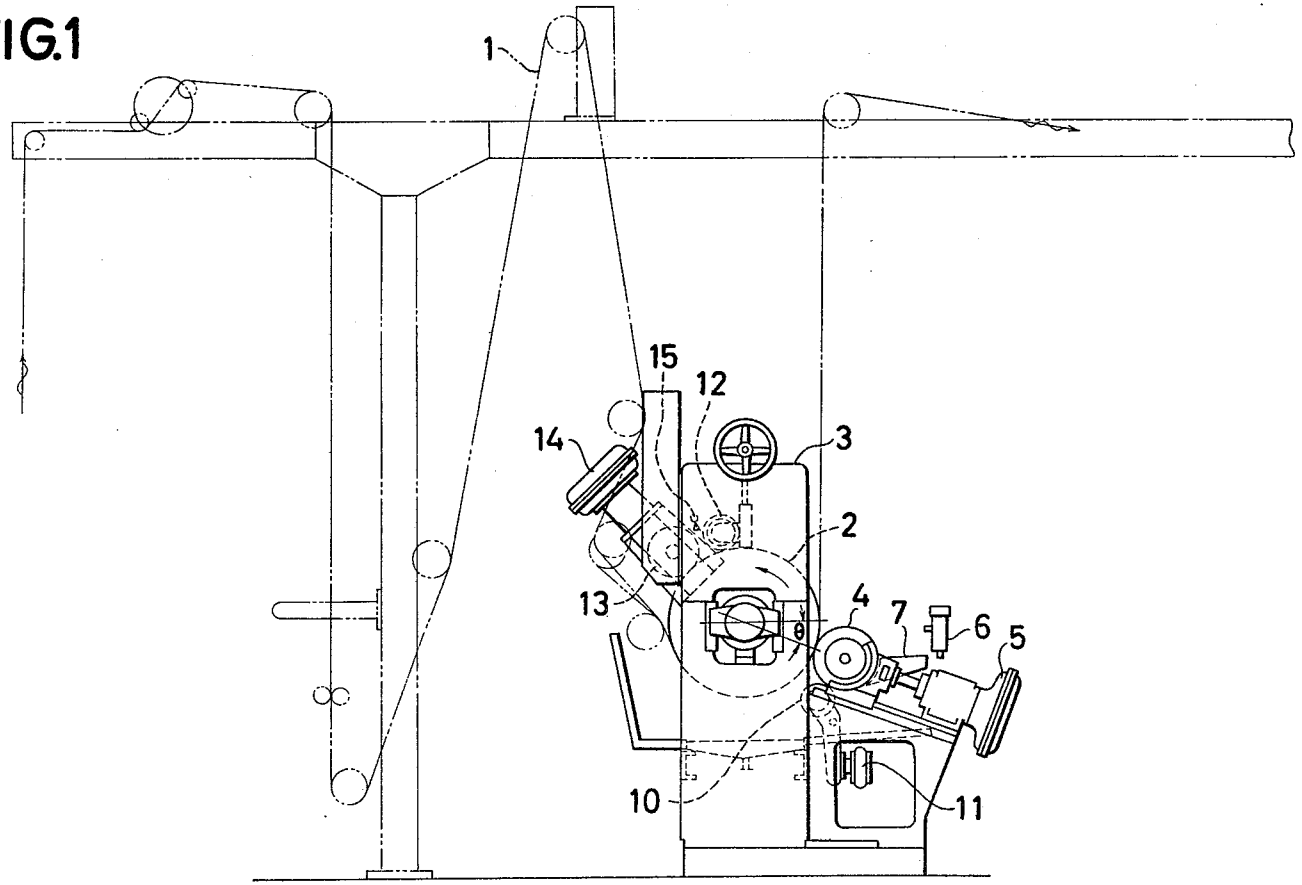
FIG. 1 is the side view of an example of the present inventive apparatus for supplying a definite amount of a treating liquid to a textile product.

In FIG. 1, 1 is a textile product to be impregnated with a dye solution or a resin solution, 2 is a rubber roll to guide the textile product to be treated. The rubber roll 2 is supported rotatably with a pair of mangle frames 3 provided on the left and the right sides thereof, and is driven by means of a motor (not shown in the figure) in the direction of the arrow. 4 is a liquid retaining roll comprising a mesh roll having small holes in close spacings or a roulette roll having numerous roulette-type unevenness in pressure contact with the textile product 1 guided by the rubber roll 2, the contact pressure between the liquid retaining roll 4 and the textile product 1 being controllable by a pressure controlling device 5.

Figure 2:
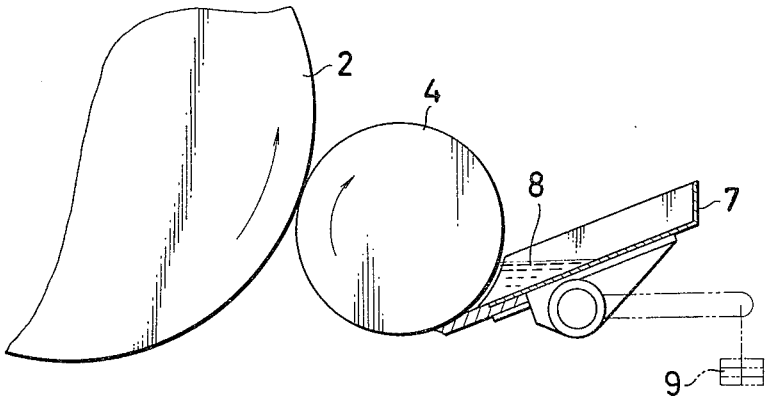
FIG. 2 is an enlarged partial figure of the essential portion thereof.
Figure 3:
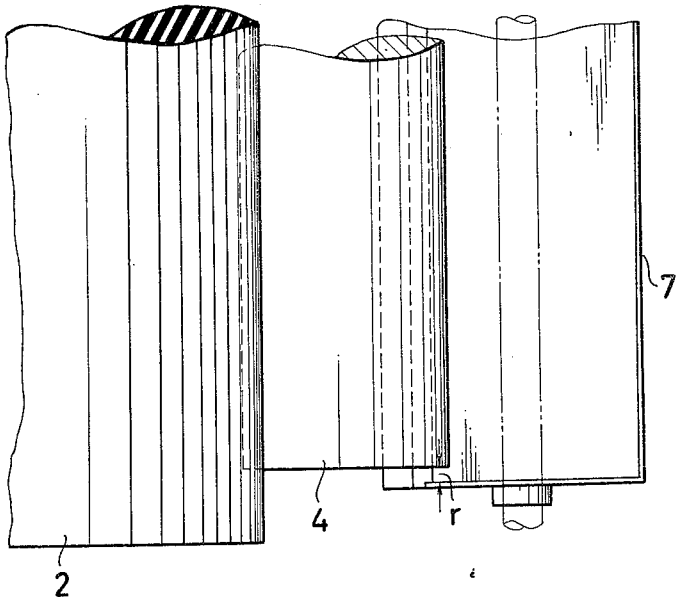
FIG. 3 is the plan view of FIG. 2.

6 is a liquid tank to store a treating liquid 8. The liquid flows down therefrom at a uniform rate and is charged into a liquid reserving vessel or container 7. As shown in FIGS. 2 and 3, the liquid reserving vessel 7 is broader than the liquid retaining roll 4 in its width so that a part of the liquid retaining roll is positioned in the interior of the liquid reserving vessel, and further, a part of the liquid retaining roll is in contact with the treating liquid 8.

The liquid reserving vessel 7 is inclined so that a part of the liquid introduced therein flows out positively from the gaps (r) provided between both sides of the liquid reserving vessel 7 and corresponding sides of the liquid retaining roll 4 to wash away flock and hards of the textile product and other dust adhering to the surface of the liquid retaining roll 4. The inclination of the liquid reserving vessel can be controlled optionally by means of a counterweight 9. 10 is a doctor roll provided in to pressure contact with the liquid retaining roll 4 to which the liquid has been supplied from the liquid reserving vessel, and the contact pressure between the doctor roll 10 and the liquid retaining roll 4 can be controlled by a pressure controlling device 11.

Figure 5:
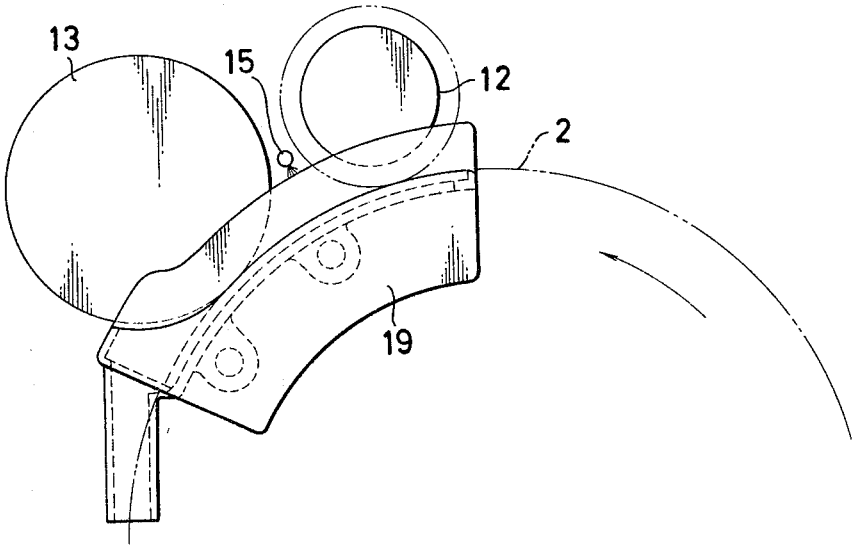
FIG. 5 is the side view of the cleaning device.

FIG. 5 shows the details of the cleaning mechanism for the rubber roll 2. 12 is a brush roll in contact with a part of the rubber roll 2 at a position where the cloth to be treated is not in contact with the rubber roll, and this brush roll 12 brushes the surface of the rubber roll 2 to remove flock and hards of the textile product and other dust adhered thereon. Following the brushing roll 12 is a liquid jetting nozzle 15 for cleaning the rubber roll 2 and the brush roll 12 by jetting a washing liquid therefrom, and a part of the treating liquid flowing down from the liquid reserving vessel 7 is utilized as the washing liquid in order to avoid the contamination with foreign liquid of the textile product being treated. 13 is a press roll in contact with the rubber roll 2 for the purpose to mop the washing liquid on the surface thereof. The contact pressure between the press roll 13 and the rubber roll 2 can be controlled by a contact pressure controlling device 14 in FIG. 1. 19 is a spout to collect the jetted washing liquid.

Figure 4:
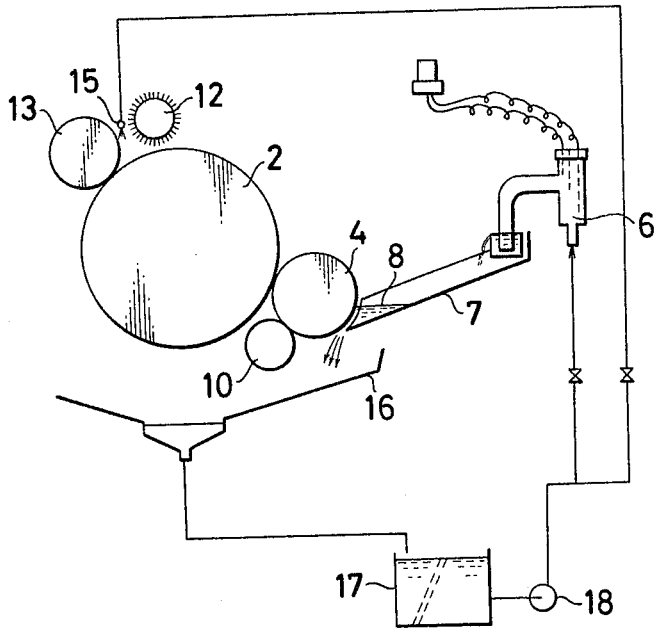
FIG. 4 is an explanatory drawing of the liquid circuit.

16 is a liquid receiving dish to receive the treating liquid flowing down from the washing liquid jetting nozzle 15 and overflowing from the liquid reserving vessel 7, and the liquid received in the liquid receiving dish 16 is filtered through a filter 17 and circulated to the liquid tank 6 and the washing liquid jetting nozzle 15 with the aid of a pump 18. The circulation system of the treating liquid can be seen in FIG. 4.

The process for supplying a definite amount of a treating liquid to a textile product by using the present inventive apparatus will now be explained in the following. The rubber roll 2 is driven in the direction of the arrow to transport the textile product to be treated 1 continuously. On the other hand, the treating liquid 8 is charged from the liquid tank 6 to the liquid reserving vessel 7 successively at a uniform rate, and the liquid is adhered on the surface of the liquid retaining roll 4 in the liquid reserving vessel 7, while a part of the liquid flows out positively from the vessel 7 to the liquid receiving dish 16 through the gaps (r). In the meanwhile, the surface of the liquid retaining roll 4 is washed with the liquid in the liquid reserving vessel 7, and flock and hards of the textile product and other dust adhering on the surface of the liquid retaining roll 4 are washed away with the liquid flowing out from the vessel 7 down to the liquid receiving dish 16. The liquid retaining roll 4 having no dirt adhering thereon is pressed in contact with the doctor roll 10 to control the treating liquid retained thereon to a prescribed amount. Then, the prescribed amount of the treating liquid is transferred through the rubber roll 2 to the cloth to be treated.

On the other hand, while flock and hards and other dust are also adhered on the rubber roll 2 guiding the textile product to be treated 1, these dirts are removed with the aid of the brush roll 12 and the washing liquid from the liquid jetting nozzle 15 to clean the rubber roll. The rubber roll 2 is then mopped with the press roll 13. The treating liquid flowing down from the liquid reserving vessel 7 and the spout 19 are collected en bloc in the liquid receiving dish 16, filtered through the filter 17 to remove the dirt and circulated to the liquid tank 6 and the liquid jetting nozzle 15.

In the present invention, as above explained, there is no danger that dirt adheres on the surface of the liquid retaining roll 4 as well as on the surface of the rubber roll 2, so that a definite prescribed amount of the treating liquid can be supplied precisely and uniformly to the textile product to be treated. Furthermore, since no knife-type doctor is used, the abrasion and damage of the liquid retaining roll surface as well as the doctor can be eliminated, and accordingly the life of the apparatus can effectively be prolonged.

What is claimed is:

1. An apparatus for continuously applying a definite amount of a treating liquid to a textile product comprising a liquid retaining roll having a surface for retaining a treating liquid thereon, a rubber roll disposed in pressure contact with said liquid retaining roll for forming a bite therebetween and said rubber roll arranged to guide the textile product to the bite so that the textile product is pressed against said liquid retaining roll for transferring a definite amount of the treating liquid to the textile product, said liquid retaining roll being rotatable about an axis, said rubber roll being rotatable about an axis in generally parallel relation with the axis of said liquid retaining roll with said rubber roll and liquid retaining roll rotating in opposite directions, a vessel located on the opposite side of said liquid retaining roll from the bite between said rubber roll and liquid retaining roll and being angularly spaced from said rubber roll, said vessel having a bottom surface sloping downwardly toward the surface of said liquid retaining roll, said vessel being arranged to contain a body of the treating liquid so that a treating liquid level is located within said vessel above the bottom thereof with the body of treating liquid contacting the surface of said liquid retaining roll, said vessel being open along the side thereof extending in the axial direction of said liquid retaining roll and adjacent said liquid retaining roll, said vessel having a length of said side so that the treating liquid therein flows out of said vessel at the opposite ends of said retaining roll for eliminating flock, hards and dust adhering to said liquid retaining roll, a doctor roll disposed in pressing contact with said liquid retaining roll and being angularly spaced from said rubber roll and said vessel so that said liquid retaining roll rotates through said vessel and contacts said doctor roll before contacting said rubber roll, and means for cleaning the surface of said rubber roll, said means including means for directing a part of the treating liquid against the surface of said rubber roll at a position angularly spaced from the bite between said rubber roll and said liquid retaining roll.

2. An apparatus, as set forth in claim 1, wherein said means for directing treating liquid against the surface of said rubber roll comprises a jetting nozzle directed toward said rubber roll for jetting the treating liquid thereagainst.

3. An apparatus, as set forth in claim 2, wherein said means for cleaning the surface of said rubber roll including a brush roll for brushing the surface of said rubber roll and a mopping roll in pressing contact with said rubber roll, and said means for directing treating liquid against the surface of said rubber roll being located between said brush roll and said mopping roll in the direction of rotation of said rubber roll.

4. An apparatus, as set forth in claim 3, including means for collecting the treating liquid flowing out of said vessel and the treating liquid directed from said jetting nozzle, and means for treating the collected treating fluid for removing the materials therein removed from said rubber roll and said liquid retaining roll.

5. An apparatus, as set forth in claim 4, including a tank for the treating liquid, said tank arranged to supply the treating liquid to said vessel and to receive the treated treating liquid after it flows through said means for removing materials therefrom.

* * * * *